US006874289B2

(12) United States Patent
Koch et al.

(10) Patent No.: US 6,874,289 B2
(45) Date of Patent: Apr. 5, 2005

(54) STARTER STRIP SHINGLE AND ROOF HAVING SAME

(75) Inventors: Stephen A. Koch, Collegeville, PA (US); Husnu M. Kalkanoglu, Swarthmore, PA (US); Robert L. Jenkins, Honey Brook, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 10/358,698

(22) Filed: Feb. 5, 2003

(65) Prior Publication Data

US 2004/0148896 A1 Aug. 5, 2004

(51) Int. Cl.[7] ..... E04D 1/34

(52) U.S. Cl. ..... 52/543; 52/98; 52/522; 52/523

(58) Field of Search ..... 52/98, 543, 522, 52/523, 518, 100; 248/909

(56) References Cited

U.S. PATENT DOCUMENTS 908,125 A * 12/1908 Overbury ..... 206/323
4,266,388 A * 5/1981 Flood ..... 52/748.1
4,637,191 A * 1/1987 Smith ..... 52/522
4,992,315 A * 2/1991 Zickell et al. ..... 428/40.3
6,145,265 A * 11/2000 Malarkey et al. ..... 52/555
6,199,338 B1 * 3/2001 Hudson et al. ..... 52/518
6,351,913 B1 * 3/2002 Freiborg et al. ..... 52/57
6,468,615 B2 * 10/2002 Weinstein et al. ..... 428/43
6,670,011 B2 * 12/2003 Weinstein et al. ..... 428/43

FOREIGN PATENT DOCUMENTS

JP 2000154620 A * 6/2000

* cited by examiner

*Primary Examiner*—Korie Chan
(74) *Attorney, Agent, or Firm*—Paul & Paul

(57) ABSTRACT

A starter strip shingle of a given vertical width is provided, having a severance line, from which a severance portion of the starter strip shingle may be removed, somewhat reducing the vertical width of the starter strip shingle, such that the installer of roofing material has an option to use full width starter strip shingles, or reduced width starter strip shingles, from the same package of uniform width starter strip shingles, to thereby enable a feathering of roofing shingles applied thereover, by means of a gentle transition zone, to avoid tears and punctures of the roofing shingles. Sealant areas on the starter strip shingles may be synchronized with the spacing and sizes of tabs of roofing shingles applied thereover, such that the sealant areas will always be under tabs of roofing shingles that are applied thereover, and not fall between the tabs into slots thereof.

23 Claims, 6 Drawing Sheets

STARTER STRIP SHINGLE AND ROOF HAVING SAME

TECHNICAL FIELD OF INVENTION

This invention relates to starter strip shingles and to roofs having starter strip shingles and roofing shingles applied thereto.

BACKGROUND OF THE INVENTION

Typically, roofs that are shingled are sloped roofs; for example, roofs having slopes with lower edges and upper edges. In starting to shingle a roof, before actual roofing shingles are applied, a course of starter strip shingles is applied, along the lower edge of the roof. In some instances, two courses of starter strip shingles are applied along the lower edge of the roof, one course over the other. Then, typically, a first course of roofing shingles is applied, overlying the uppermost course of starter strip shingles (or overlying the single course of starter strip shingles where only a single course of starter strip shingles is being used). In many instances, the roofing shingles that are being applied to the roof are shingles having upper headlap portions and lower tab portions, with the tab portions comprising spaced-apart tabs that are spaced by vertical slots. The slots can be of narrow width, or can be of greater width, such as the width of a tab of the roofing shingle.

Whatever the spacing of tabs of roofing shingles, or width of slots separating such tabs, it will be apparent that, whenever a course of roofing shingles having tabs that are spaced apart by slots of any width are placed into overlying relation over a course of starter strip shingles, portions of the upper or anterior surface of the course of starter strip shingles are visible through the open slots that separate adjacent tabs of roofing shingles in the course of roofing shingles placed thereover.

Thus, the use of starter strip shingles is necessary for the protection of the roof, as well as for aesthetic purposes.

It is also customary that starter strip shingles have sealant along their leading edges (lowermost edges) to allow the first course of roofing shingles to seal thereover.

In many instances, often depending upon the particular design of the roofing shingles that are to be applied, the starter strip shingles may need to be applied in double thickness, for example in two courses, one course applied over the other. For example, U.S. Pat. No. 6,199,338 discloses a double course of starter strip shingles.

When a double thickness (or two courses) of starter strip shingles are used, and then a first course of roofing shingles is applied thereover, with the shingles in the first course of roofing shingles being of greater width than the underlying starter strip shingles from top to bottom, as measured from the top edge of the roofing shingle to the bottom edge of the roofing shingle, the roofing shingle forms a substantial hump, where it transitions from the upper edge of the double layer of starter strip shingles to the roof deck where no starter strip shingles are applied. Such a transition hump may be not only aesthetically unsightly, but may also cause the first course of roofing shingles to crack or tear at the point of the transition, possibly creating a leak at the location of the transition just above the upper edges of the starter strip shingles.

In the roofing industry, such potential failure of a first course of roofing shingles is recognized as being a potential problem when a double course of starter strip shingles is used beneath a first course of roofing shingles. In order to minimize such prospects of roofing shingle failure, some manufacturers have made starter strip shingles of varying widths from upper to lower edges of the starter strip shingles, so that the transition of an overlying roofing shingle is more gentle, in that the roofing shingle undergoes a step down from a second applied course of starter strip shingles to a first course of starter strip shingles, and then further steps down to the roof deck. Such starter strip shingles of varying widths have, to date, been applied in roll form, generally from a roll that is about 36 inches in width, as measured from upper edge to lower edge, with such a roll being slit longitudinally, creating two rolls, of different widths, such as one roll being 22 inches in width from upper edge to lower edge that is first applied to a roof deck, with the second roll being, for example, 14 inches in width that is then applied to the roof deck, forming a second starter strip course over the first starter strip course, with a second starter strip course being 8 inches shorter in width.

Thus, the large hump created from transitioning a first course of roofing shingles from a double course of starter strip shingles that are of the same width, as shown in the prior art illustration of FIG. 1, is feathered or smoothed out somewhat in the prior art illustration of FIG. 2.

SUMMARY OF THE INVENTION

The present invention provides a starter strip shingle of a given width that is provided with a predetermined severance line that provides the shingle installer with the option of using the starter strip shingle with its full width, or alternatively shortening the width of the starter strip shingle by severing it along its predetermined severance line, such that a single size of starter strip shingle may be used to create a staggered reduction in thickness when dual starter strips are being applied to a roof. Thus, a gentle transition is effected from a second-applied course of starter strip shingles, to a first-applied course of starter strip shingles, and then to the roof deck, such that an undesirable "humping" is avoided, in that there is no rapid transition from a second course of starter strip shingles to the roof deck; nor is there the necessity of having starter strip roll shingle material or starter strip shingles of two different manufactured widths available at the site of installation.

Additionally, the starter strip shingles are provided with spaced-apart sealant areas on the front or anterior surfaces thereof, against which the posterior surfaces of roofing shingles can be engaged, with the sealant areas being spaced apart an amount that is synchronized with the spacing apart of tabs of overlying roofing shingles applied thereto, such that the sealant always lines up with tabs applied thereover, and not with slot areas between tabs of roofing shingles.

The present invention also resides in roofs having the above-mentioned features.

Accordingly, it is a object of this invention to provide a starter strip shingle having a severance line by which a portion of the starter strip shingle can be severed, to yield a starter strip shingle of reduced width from its upper to its lower edge.

It is another object of this invention to provide starter strip shingles that may be used to form two or more courses of starter strip shingling on a roof, but wherein lines of severance may be used to shorten the width of desired starter strip shingles, such that multiple courses of starter strip shingles on a roof may be of different widths from upper to lower edges, such that roofing shingles applied thereover may have a gentle transition from the uppermost course of starter strip shingles to the roof deck.

It is another object of this invention to provide starter strip shingles with areas of sealant therealong, that are spaced apart an amount that is synchronized to correspond with the spacing of spaced-apart tabs of roofing shingles applied thereover, so that such areas of sealant are covered by tabs, and do not appear at the locations where slots exist in roofing shingles between roofing shingle tabs.

It is another object of this invention to provide starter strip shingles having combinations of the above-mentioned features of the objects set forth above.

It is a further object of this invention to provide roofs having one or more features of the above-mentioned objects.

Other objects and advantages of the present invention will be readily apparent upon a reading of the following brief descriptions of the drawings figures, the detailed descriptions of the preferred embodiments, and the appended claims.

BRIEF DESCRIPTIONS OF THE DRAWING FIGURES

DETAILED DESCRIPTIONS OF THE PREFERRED EMBODIMENTS

Figure 1:
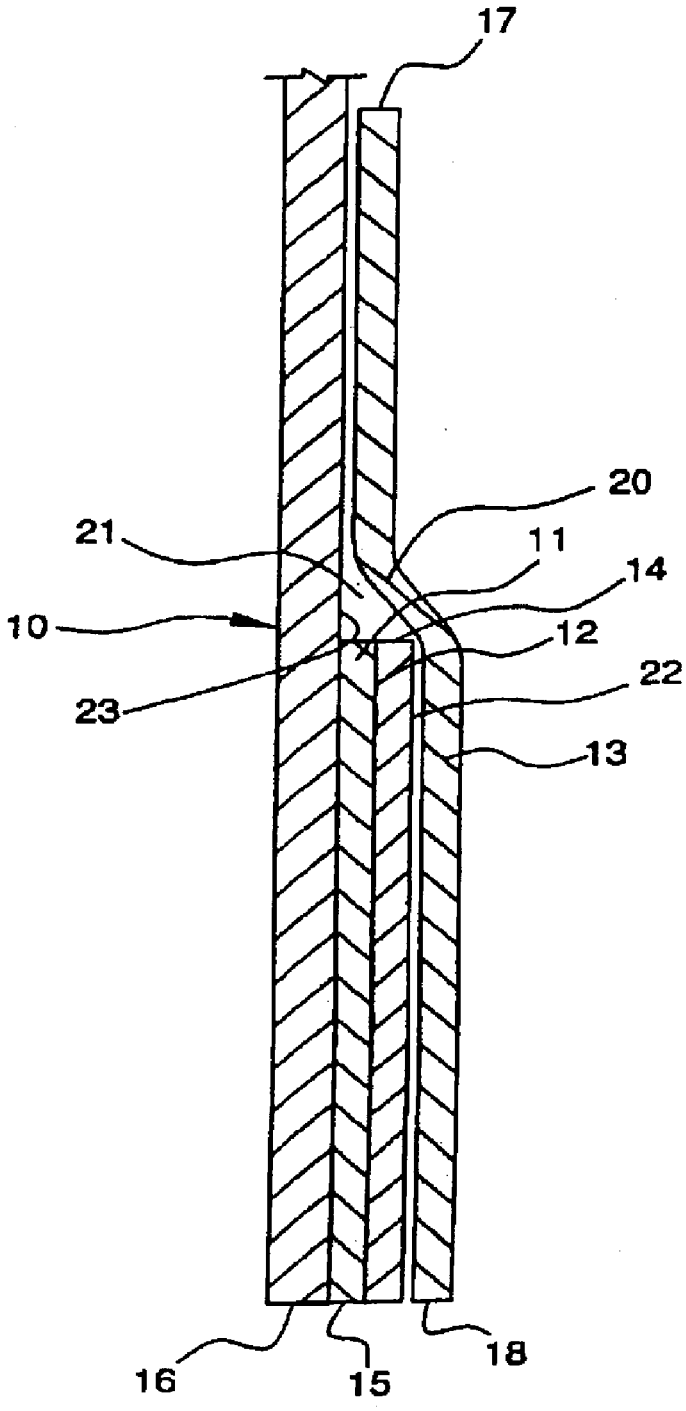
FIG. 1 Prior Art
FIG. 1 is a vertical sectional view, taken through a portion of a roof deck and through a dual course of starter strip shingle material and a single course of roofing shingle applied thereover, in accordance with the prior art.

Referring now to the drawings in detail, reference is first made to FIG. 1, wherein a prior art starter strip shingle arrangement is shown, whereby a roof deck generally designated by the numeral 10 is shown in fragmentary section as having a first layer 11 of starter strip shingle material applied thereto, over which a second layer 12 of starter strip shingle material is applied, and wherein the roofing shingle 13 is illustrated applied thereover, with a roofing shingle 13 being of substantially greater (approximately double) the width of the starter strip shingle materials 11 and 12, as shown. Thus, the width of each of the starter strip shingle materials 11, 12, between their upper and lower edges 14, 15 is the same, with the lower edges 15 thereof being substantially aligned with the lower edge or eave 16 of the roof deck, such that the first course of roofing shingles 13 of greater width applied over the starter strip shingle material 11, 12, from upper edge 17 to lower edge 18, is such that the roofing shingle 13 undergoes an abrupt transition at the location 20, creating a void 21 between the anterior surface 22 of the starter strip shingle material 12 and the upper surface 23 of the roof deck as shown in FIG. 1. It will be understood that the shingle material 11, 12 and shingles 13 are attached to the roof deck 10 by suitable nails, staples or the like, and that, in accordance with such prior art constructions, a roofing felt of tarpaper or the like (not shown) may first be applied to the roof deck prior to any starter strip shingle or roofing shingles applied thereover.

Generally, the starter strip shingle material 11, 12 comes in rolled form, with each roll thereof being disposed on the roof deck 10 above it's eave 16, to be unrolled and then fastened in place. It will be understood that in some applications, such as where the roof deck 10 is disposed as a steep slope, the weight of a roll of shingle material may be difficult for an installer to handle upon application.

Figure 2:
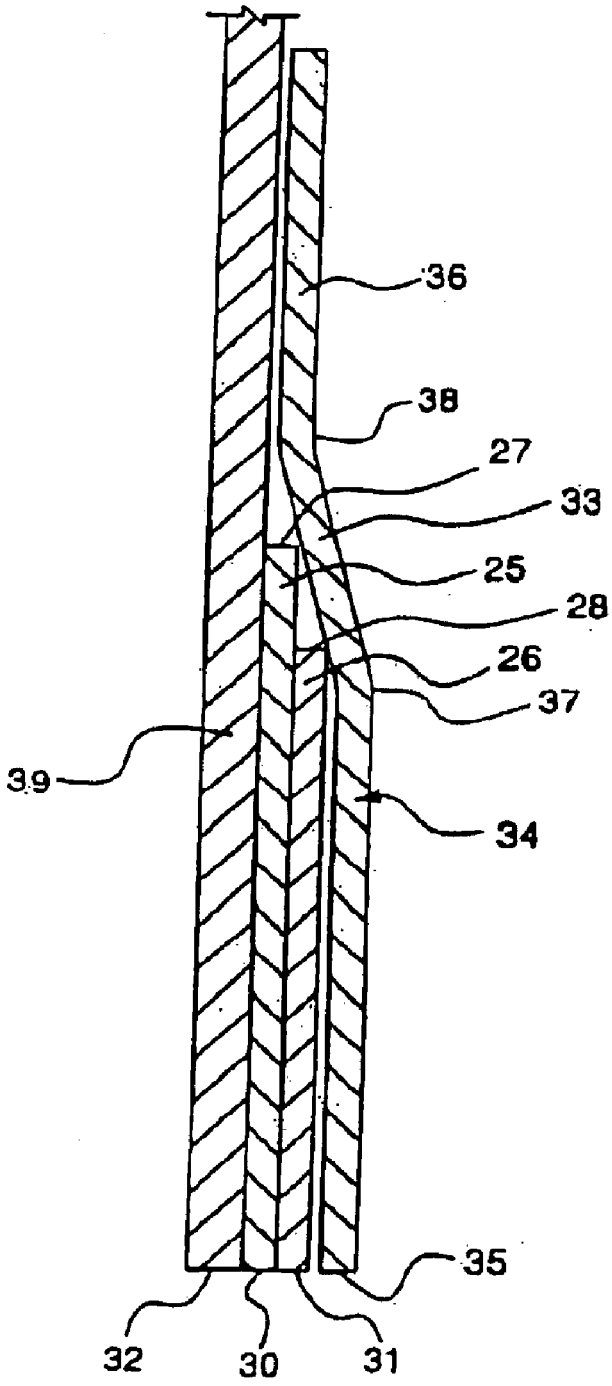
FIG. 2 Prior Art
FIG. 2 is an illustration similar to that of FIG. 1, but wherein the uppermost course of starter strip shingle material is of shorter width than the subjacent course of starter strip shingle material, also in accordance with the prior art.

With reference now to FIG. 2, an alternative prior art application of starter strip shingle material in two layers 25, 26, of different widths from top edges 27, 28, to lower edges 30, 31 is shown, but aligned at their lower edges 30, 31 with the lower edge or eave 32 of the roof deck 39. This starter strip shingle material 25, 26 is likewise provided in rolls. Typically, such material is provided in a roll with a width of 36 inches, which is then slit longitudinally, to yield two manufactured rolls, perhaps 22 inches and 14 inches, respectively, in width, which are applied to a roof deck, generally as shown in FIG. 2, with the material 25 of greater width applied first, and the material 26 of lesser width applied thereover, to yield a stepped-down transition zone 33 for a roofing shingle 34 applied thereover, with its lower edge 35 aligned with the edges 30, 31, 32, as shown, and with the upper or headlap portion 36 of the roofing shingle 34 applied to the roof deck 39 in a conventional manner. This gentler transition zone 33, relative to that 20 of the embodiment of FIG. 1, is somewhat an improvement over the prior art embodiment of FIG. 1, in that, once applied, it is not as prone to tearing or other types of rupture in the transition zone 33 between approximate locations 37 and 38 of the shingle 34. However, the use of two separate widths of shingle material 25, 26 requires the roofer to stock different sizes of the rolled roofing shingle material, thereby increasing inventory requirements, which necessarily increases the expense of applying a roof.

Figure 3:
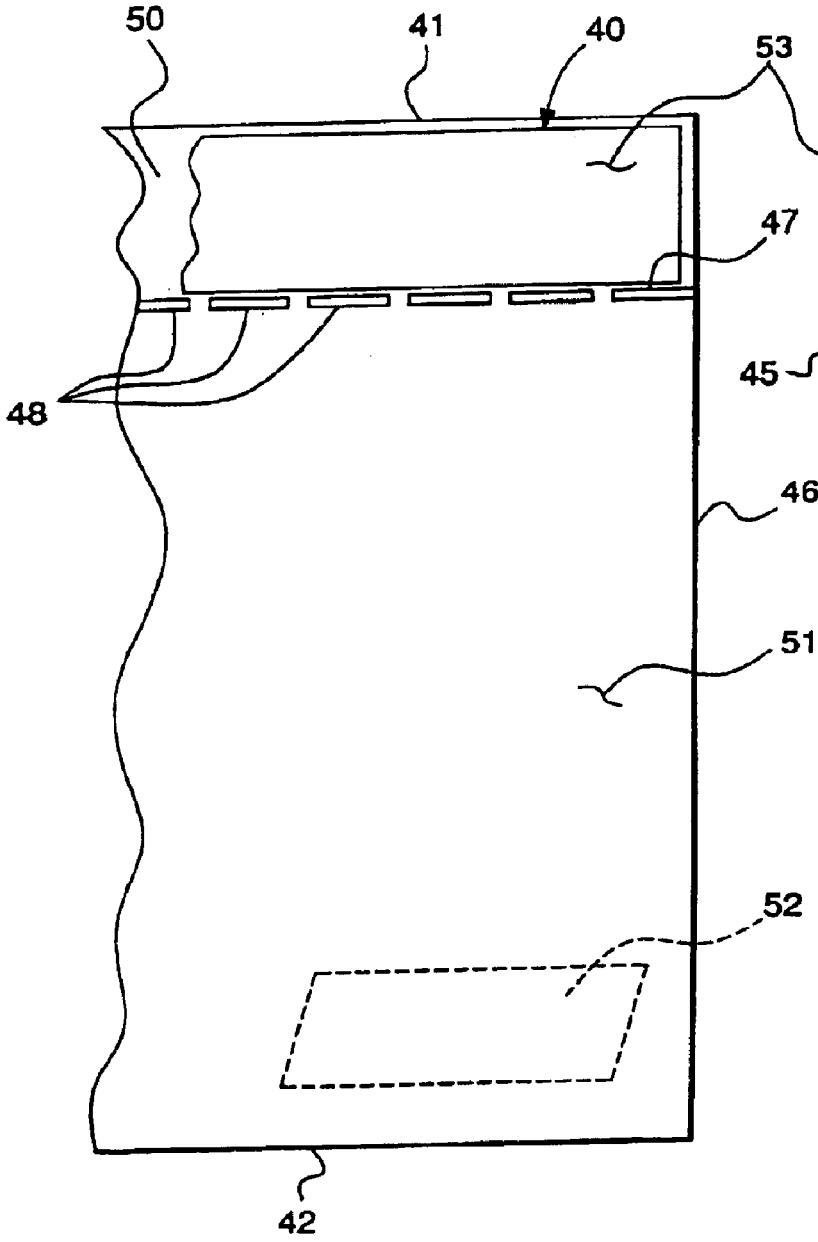
FIG. 3 is a fragmentary view of a posterior or rear surface of a starter strip shingle, with one form of perforation means and with sealant area shown in dotted line form on the anterior surface of the starter strip shingle.

With reference now to FIG. 3, a starter strip shingle 40 in accordance with this invention is shown, fragmentally illustrated at its left end, as comprising a typical manufactured shingle construction, having a base mat of fibrous material such as fiberglass (not shown), that is impregnated with a bituminous material such as asphalt (not shown), with a layer 43 of granules on the anterior surface 44, and with a posterior surface 45 as an opposite surface, of typical shingle construction. The surface 45 may also typically have a particulate material such as mica or the like (not shown) thereon.

A starter strip shingle 40 in accordance with this invention may be of any desired length in the longitudinal direction; from its right edge 46 to a left edge (not shown), for example being 40 inches or the like. The width of the starter strip shingle in accordance with this invention between upper and lower edges 41, 42 would typically be about 13¼ inches.

The shingle 40 is applied to a roof with its posterior surface 45 disposed against a roofing felt (not shown) that has been applied over a roof deck (not shown). This leaves the anterior surface 43 of the starter strip shingle disposed upwardly.

Perforation means such as a line of indentations 47, spaced apart from each other in the posterior surface 47 defines a severance line 48 disposed longitudinally of the starter strip shingle 40, as shown in FIG. 3, between right and left edges thereof, at a predetermined distance below the upper edge 41 of the starter strip shingle 40, as shown. This distance can be, for example, 2 inches, separating the starter strip shingle 40 into a severance portion 50 and a remaining portion 51.

Figure 4:
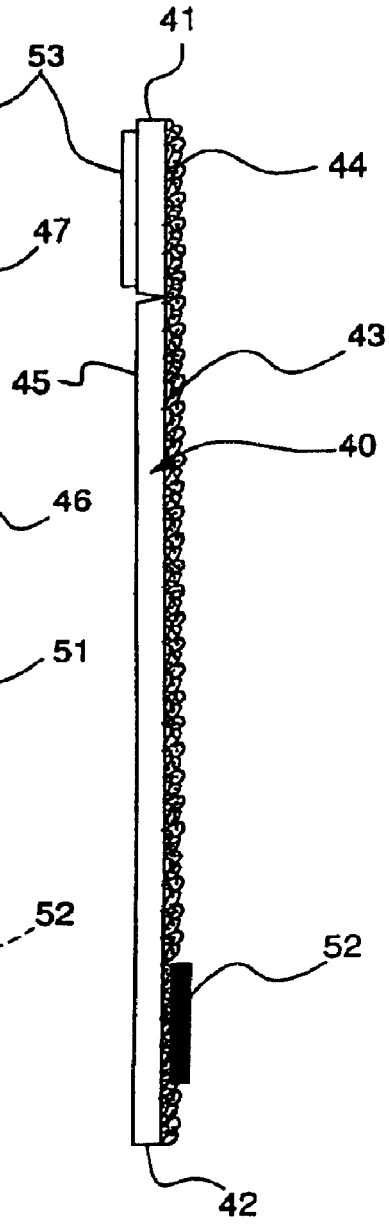
FIG. 4 is a right end view of the starter strip shingle of FIG. 3.

While the perforation means 47 as illustrated in FIGS. 3 and 4 appears as indentations that are spaced apart from each other, as shown, it will be understood that, within the spirit and scope of this invention, the perforation means can be indentations as shown that are longitudinal and which extend partially through, or almost completely through the starter strip shingle 40, to a point where they are just covered by the granules 44 on the anterior surface. Alternatively, the perforation means 47 may comprise a line of dots that are spaced apart from each other, extending partially through the starter strip shingle 40 like the indentations 47, or completely through the starter strip shingle 40, as may be desired. Further, alternatively, the perforation means may simply comprise a reduced thickness portion of the starter strip shingle 40, or a line simply of predetermined weakness. Whatever form the perforation means takes, it enables one to bend the severance portion 50 of the starter strip shingle so that it readily separates from the remaining portion 51 of the starter strip shingle. This bending can be accomplished by moving the two portions of the starter strip shingle relative to each other in a back-and-forth motion until there is a complete severance along the severance line 48, or the severance portion 50 may simply be torn away from the remaining portion 51.

The result of severing a severance portion 50 from the remaining portion 51 of the starter strip shingle, is that the starter strip shingle may be reduced in width. Thus, a given starter strip shingle may be used as a full width starter strip shingle of a width as measured between edges 41 and 42, or as a reduced width starter strip shingle, measured between the edge created by severing the severance portion 50 along the line 48 and the lower edge 42 of the starter strip shingle.

Additionally, the starter strip shingle has a plurality of spaced apart sealant areas 52 on its anterior surface 43, as shown in FIG. 4, and as appears in dotted line form in FIG. 3. These sealant areas will generally be near the lower edge 42 of the starter strip shingle 40 and will comprise a bituminous material such as asphalt or the like that will enable either another starter strip shingle that is applied against the anterior surface 43 of the starter strip shingle 40 to adhere thereto, or will enable a roofing shingle applied against anterior surface 43 to adhere thereto, especially when subjected to the heat caused by the sun's rays.

For purposes of facilitating the stacking of a number of starter strip shingles together, a release tape 53 will generally be provided on one of the anterior and posterior surfaces 45, 44 of the starter strip shingle 40, for example, as shown on the posterior surface 45 above the severance line 48, from a point near the right edge 46 of the shingle, and continuing along, just under the upper edge 41 of the starter strip shingle 40, in the longitudinal direction, for the length of the starter strip shingle. The release tape 53 is of a dimension as measured widthwise from upper end to lower end, such that when a starter strip shingle like that 40 shown in FIGS. 3 and 4 is inverted and placed against the starter strip shingle 40 such that alternate shingles in a stack have adjacent such starter strip shingles disposed against each other, each alternate one has its release tape 40 disposed against the sealant area 52 of an adjacent starter strip shingle in the stack as is addressed more fully hereafter with reference to FIG. 7.

Figure 5:
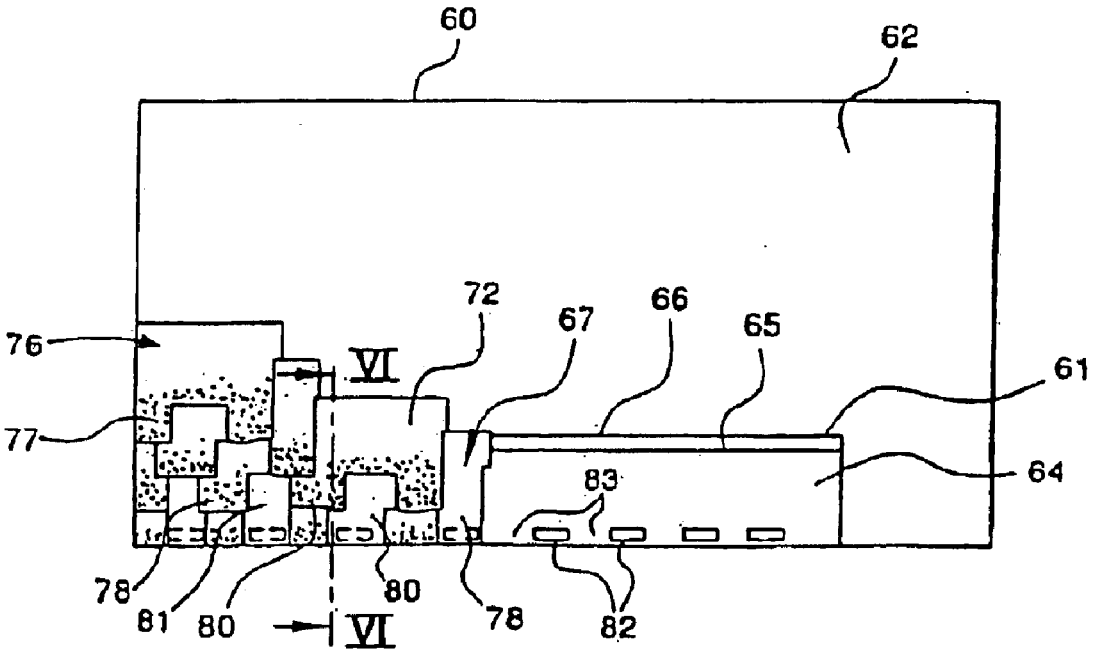
FIG. 5 is a plan view of starter strip shingle courses and roofing shingle courses applied to a partially shingled sloped roof.

With reference now to FIG. 5, it will be seen that a roof deck 60 covered with a roofing felt 62 is shown, and wherein a full size starter strip shingle 61 is applied over the roofing felt 62, near a lower edge or eave 63, and having a reduced width starter strip shingle 64 applied thereover, in a next course, as shown, with its upper edge 65 positioned below the upper edge 66 of the starter strip shingle 61, an amount represented by the severance portion that has been removed from the starter strip shingle 64 by severing the severance portion along the severance line 65, similar to the severance line 48 for the shingle depicted in FIGS. 3 and 4.

Figure 6:
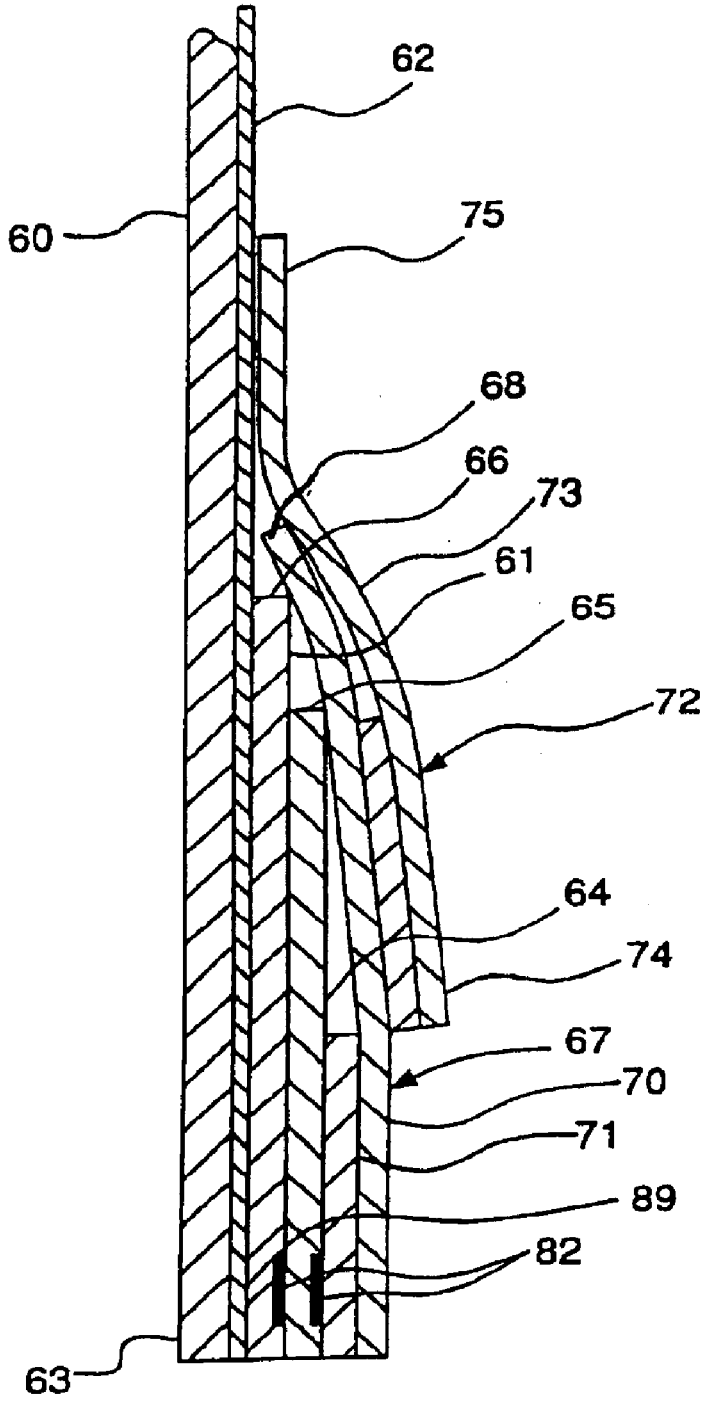
FIG. 6 is an enlarged vertical sectional view taken through the roof deck, roofing felt, starter strip shingles and roofing shingles of FIG. 5, generally along the line VI—VI of FIG. 5.

Thus, for the roof being shingled in FIG. 5, the stepped-down starter strip shingles 61 and 62, form a gentle transition for a roofing shingle 67 being applied thereover as a first course, such that the upper edge 68 of the roofing shingle 67 has a "feathered", or more gentle approach toward the felt 62 and its underlying roof deck 60, as shown in FIG. 6, than would be the case if both courses of starter strip shingles 61 and 64 were of the same vertical width.

It will be noted that the shingles 67 are laminated shingles, each comprising an anterior shingle layer 70 and a backing layer 71 of reduced width. For example, for the shingle 67 shown in FIG. 6, the vertical width of the layer 70 may be on the order of 14¼ inches wide, whereas the posterior layer 71 laminated thereagainst may be on the order of 5¾ inches wide.

Then, when a next course of roofing shingles 72 is applied as shown in FIG. 6, it will also have the benefit of the gentle transition zone 73, as lower portions 74 of that roofing shingle are spaced farther away from the roof deck 60, due to the multiple thicknesses of starter strip shingle and multiple layers of the first course of shingles 67 causing such spacing from the roof deck 60, whereas the upper ends 75 of the shingles 72 in the second course are spaced more closely to the roof deck 60, as shown, providing a gentle transition for avoidance of puncturing, tearing, etc in the transition zone 73.

It will be noted that each of the shingles 67, 72 in the courses of shingles as shown have an upper headlap portion 76 and a lower tab portion 77, with the tab portion 77 comprising spaced apart tabs 78, 80, for example, separated by slots 81.

The starter strip shingles of this invention are provided with spaced-apart sealant areas 82 separated by zones 83 having no sealant thereon. The sealant areas 82 are synchronized in their size and placement as measured longitudinally of the starter strip shingle so as to be synchronized with the spaced-apart tabs 78, 80 and the like, such that when the roofing shingles 67 are applied over starter strip shingles such as that 64, the tabs such as 78, 80 will be located directly over the sealant areas 82, to be capable of adhering the lower ends of the tabs 78, 82 of the first course of roofing shingles to the lower ends of the starter strip shingle 64.

Also, when starter strip shingles 64 are applied over the starter strip shingles 61, the sealant areas 89 thereover will adhere to the posterior surfaces of the starter strip shingles 64 applied thereover, as shown in FIG. 6.

In accordance with this invention, it will be apparent that the perforation means on the starter strip shingles creates a hinge point by which starter strip shingles of a single given size offer the option of being converted to starter strip shingles of lesser width, or not, so that a given size of starter strip shingle can be used for placement of either a single layer of starter strip shingles on a roof, or multiple layers.

When dual courses of starter strip shingles are desired, it is thus possible, in accordance with this invention to use starter strip shingles of the same size, from the same bundle, and still have a transition zone, by simply bending the severance portion of a starter strip shingle along the severance line until it tears therealong, creating shorter width starter strip shingles, so that, when applied to a roof as shown if FIG. 5, the desired transition zone is present for the first course of overlying roofing shingles, and then for the second course of overlying roofing shingles, so that the desired gentle transition is effected without requiring at the site of application of shingles, starter strip shingles manufactured to be of different widths.

Figure 7:
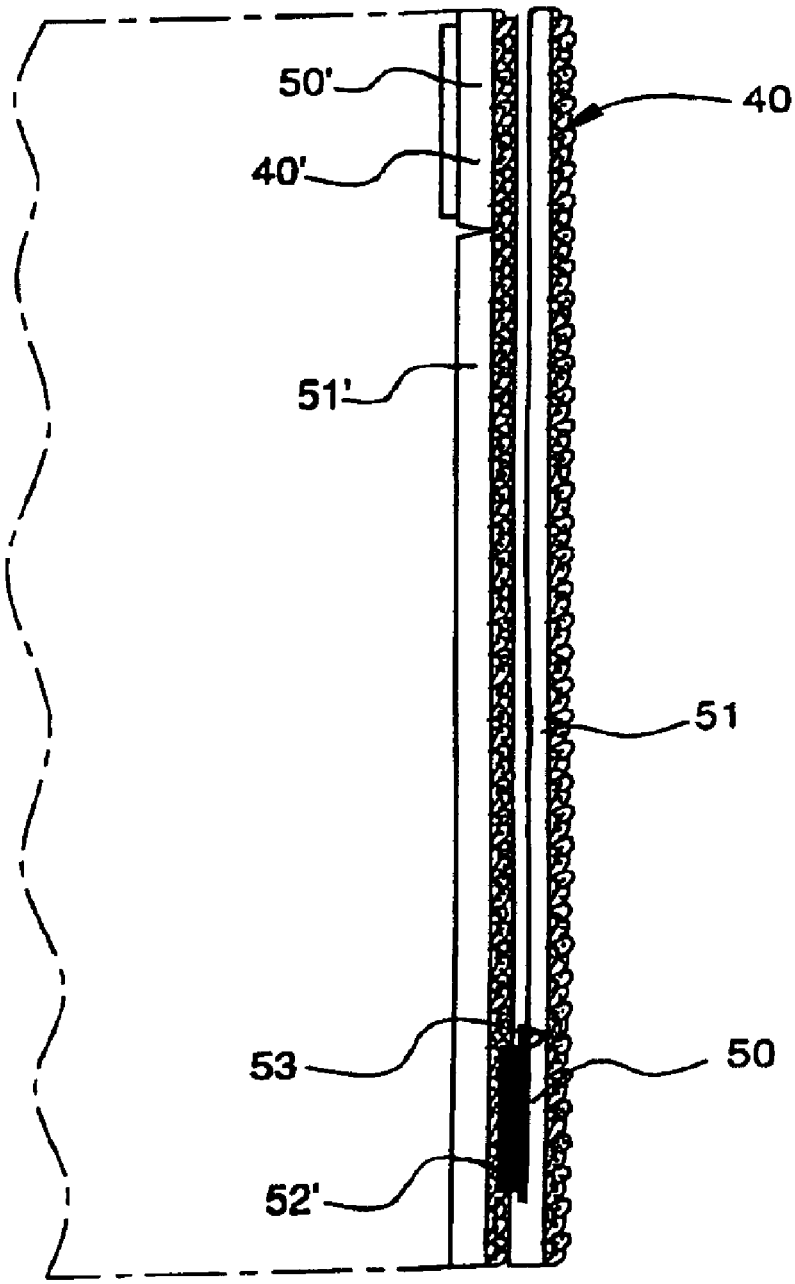
FIG. 7 is an end view of a pair of alternately packaged starter strip shingles in accordance with this invention, diagrammatically illustrated also in partial phantom view at the left side thereof, to represent many such shingles in a stack.

With reference to FIG. 7, it will be seen that a plurality of starter strip shingles 40, 40' are shown, with the shingles being disposed in alternating fashion to one another, such that, for the starter strip shingle 40, the severance potion 50 is shown inverted, below the remaining portion 51, whereas for the next starter strip shingle 40' to the left, the severance portion 50' is above the remaining portion 51'. In this manner, the release tape 53 carried by the severance portion 50 of starter strip shingle 40 is to the bottom left, overlying the adhesive area 52' of starter strip shingle 40', preventing the starter strip shingles 40 and 40' from sticking to each other.

In diagrammatic form in FIG. 7, represented by the phantom lines, it will be understood that going from right to left in the stack of shingles, every alternate shingle is either inverted like shingle 40, or upstanding like shingle 40', such that the starter strip shingles may be packaged in such a manner that adjacent shingles in the stack will not become adhered to each other.

It will be apparent from the foregoing that various other details of construction and use of the starter strip shingles in accordance with this invention may be employed, all within the spirit and scope of the invention as defined in the appended claims.

What is claimed is:

1. A starter strip shingle for use in shingling a roof by applying a plurality of starter strip shingles end-to-end across a roof, adjacent a lower edge of a sloped roof, the starter strip shingle being of predetermined thickness between anterior and posterior surfaces and comprising:

(a) a base mat of fibrous material;

(b) the base mat being impregnated with a bituminous material;

(c) a layer of granules on an anterior surface of the starter strip shingle;

(d) the starter strip shingle, as viewed in the orientation in which it is to be applied to a roof, having an upper headlap portion and a lower portion, with the shingle having right and left edges establishing the length of the shingle and upper and lower edges establishing the width of the shingle between upper and lower edges of the shingle, with the lower edge of the shingle to be aligned with a lower edge of a roof to which the shingle is to be applied; and (e) perforation means in the headlap portion of the shingle defining a severance line between said right and left edges, generally parallel to and beneath said upper edge of the shingle, and disposed less than half-way from said upper edge of the shingle to said lower edge of the shingle;

(f) a severance portion of the starter strip shingle in the headlap portion of the shingle defined by the upper edge of the shingle and the severance line;

(g) whereby the severance portion of the shingle is readily severed from the remainder of the starter strip shingle by folding the severance portion along the severance line to break the severance portion from the remainder of the starter strip shingle to define a smaller starter strip shingle having said length between said right and left edges.

2. The starter strip shingle of claim 1, wherein the perforation means comprises a plurality of spaced-apart perforations between right and left edges of the starter strip shingle.

3. The starter strip shingle of claim 2, wherein the perforation means comprise a plurality of generally aligned linear perforations.

4. The starter strip shingle of claim 2, wherein the perforation means extends at least substantially completely through the impregnated mat.

5. The starter strip shingle of claim 2, wherein the perforation means extends from the posterior surface of the shingle into the thickness of the shingle.

6. The starter strip shingle of claim 1, wherein the perforation means comprises a plurality of spaced-apart perforations between right and left edges of the starter strip shingle, wherein the perforation means comprises a plurality of generally aligned linear perforations, wherein the perforation means extends at least substantially completely through the impregnated mat, and wherein the perforation means extends from the posterior surface of the shingle into the thickness of the shingle.

7. The starter strip shingle of claim 1, wherein the perforation means comprises a continuous perforation line.

8. The starter strip shingle of claim 7, wherein the perforation means extends at least substantially completely through the impregnated mat.

9. The starter strip shingle of claim 7, wherein the perforation means extends from the posterior surface of the shingle into the thickness of the shingle.

10. The shingle of any one of claims 1–9, wherein the severance portion is about 10%–20% of the width of the starter strip shingle.

11. The starter strip shingle of claim 1, with (h) a plurality of sealant areas on the granules on the front surface of the starter strip shingle, with the sealant areas being disposed spaced apart from each other a predetermined distance, in a line between left and right edges of the starter strip shingle, adjacent and substantially parallel to the lower edge of the starter strip shingle.

12. A roof having a double course of starter strip shingles applied end-to-end across a roof, adjacent a lower edge of a sloped roof, each starter strip shingle being of predetermined thickness between anterior and posterior surfaces and comprising:

(a) a base mat of fibrous material;

(b) the base mat being impregnated with a bituminous material;

(c) a layer of granules on an anterior surface of the starter strip shingle;

(d) the starter strip shingle, as viewed in the orientation in which it is applied to the roof, having an upper headlap portion and a lower portion, with the shingles having right and left edges establishing the length of the shingle and upper and lower edges establishing the width of the shingle between upper and lower edges of the shingle, with the lower edge of the shingle aligned with a lower edge of a roof to which the shingle is applied; and (e) perforation means in the headlap portion of the shingle defining a severance line between said right and left edges, generally parallel to and beneath said upper edge of the shingle, and disposed less than half-way from said upper edge of the shingle to said lower edge of the shingle;

(f) a severance portion of the starter strip shingle in the headlap portion of the shingle, defined by the upper edge of the shingle and the severance line;

(g) whereby the severance portion of the shingle is readily severed from the remainder of the starter strip shingle by folding the severance portion along the severance line to break the severance portion from the remainder of the starter strip shingle to define a smaller starter strip shingle having said length between said right and left edges;

(h) with the first course of starter strip shingles being installed on the roof with their severance portions attached to the remainder of the starter strip shingles; and (i) with the second course of starter strip shingles overlapping the first course and having their severance portions severed from the remainder of the starter strip shingles in that course with the severance lines of starter strip shingles in the second course defining the upper edges of the shingles in the second course and with the shingles in the second course being applied to the first course to leave severance portions of the first course of starter strip shingles visibly protruding above the severance lines that define the upper edges of the second course of starter strip shingles when installed;

(j) whereby a stepped reduction in overall thickness of the two courses of starter strip shingles is provided.

13. The roof of claim 12, wherein the perforation means comprises a plurality of spaced-apart perforations between right and left edges of the starter strip shingle.

14. The roof of claim 12, wherein the perforation means comprises a plurality of generally aligned linear perforations.

15. The roof of claim 12, wherein the perforation means extends at least substantially completely through the impregnated mat.

16. The roof of claim 13, wherein the perforation means extends from the posterior surface of the shingle into the thickness of the shingle.

17. The roof of claim 12, wherein the perforation means comprises a plurality of spaced-apart perforations between right and left edges of the starter strip shingles, wherein the perforation means comprises a plurality of generally aligned linear perforations, wherein the perforation means extends at least substantially completely through the impregnated mat, and wherein a perforation means extends from the posterior surface of the shingle into the thickness of the shingle.

18. The roof of claim 12, wherein the perforation means comprises a continuous perforation line.

19. The roof of claim 18, wherein the perforation means extends at least substantially completely through the impregnated mat.

20. The roof of claim 18, wherein a perforation means extends from the posterior surface of the shingle into the thickness of the shingle.

21. The roof of any one of claims 12–20, wherein the severance portion is about 10%–20% of the width of the starter strip shingle.

22. The roof of claim 12, with (k) a plurality of sealant areas on the granules on the front surface of at least the second course of each starter strip shingle, with the sealant areas being disposed spaced apart from each other a predetermined distance, in a line between left and right edges of the starter strip shingle, adjacent and substantially parallel to the lower edge of the starter strip shingle.

23. The roof of claim 22, wherein (l) a first course of roofing shingles is provided, over the second course of starter strip shingles, wherein the roofing shingles in the first course each includes headlap portions and tab portions, with the tab portions comprising spaced-apart tabs separated by open slot areas; and (m) wherein the sealant areas of the at least second course of starter strip shingles are spaced apart in said line an amount that corresponds to and is synchronized with the spaced-apart tabs of the first course of roofing shingles, whereby the sealant areas on the starter strip shingles are covered by tabs of the first course of roofing shingles applied thereover.

* * * * *